US007614443B2

(12) United States Patent
Usui et al.

(10) Patent No.: US 7,614,443 B2
(45) Date of Patent: Nov. 10, 2009

(54) HEAT EXCHANGER TUBE

(75) Inventors: Shoichiro Usui, Numazu (JP); Koichi Hayashi, Mishima (JP); Tadahiro Goto, Fuji (JP)

(73) Assignee: Usui Kokusai Sangyo Kaisha Limited (JP)

( * ) Notice: Subject to any disclaimer, the term of this patent is extended or adjusted under 35 U.S.C. 154(b) by 132 days.

(21) Appl. No.: 11/516,199

(22) Filed: Sep. 6, 2006

(65) Prior Publication Data

US 2007/0056721 A1 Mar. 15, 2007

(30) Foreign Application Priority Data

Sep. 9, 2005 (JP) ..... 2005-263102

(51) Int. Cl.
*F28F 1/00* (2006.01)
*F28F 1/14* (2006.01)
*F28F 1/36* (2006.01)

(52) U.S. Cl. ..... 165/177; 165/183

(58) Field of Classification Search ..... 165/177, 165/183

See application file for complete search history.

(56) References Cited

U.S. PATENT DOCUMENTS 4,125,149 A * 11/1978 Kritzler et al. ..... 165/10
5,107,922 A 4/1992 So
5,560,424 A * 10/1996 Ogawa ..... 165/183
5,623,989 A * 4/1997 Kroger ..... 165/152
5,625,229 A * 4/1997 Kojima et al. ..... 257/712
7,303,002 B2 * 12/2007 Usui et al. ..... 165/109.1
2004/0050538 A1 3/2004 Sunder et al.
2005/0121179 A1 * 6/2005 Shibagaki et al. ..... 165/153
2005/0161208 A1 * 7/2005 Sucke et al. ..... 165/177

FOREIGN PATENT DOCUMENTS

| | | |
|---|---|---|
| GB | 1 184 125 | 7/1968 |
| JP | 62-5098 | 1/1987 |
| JP | 11-23181 | 1/1999 |
| JP | 2000-111277 | 4/2000 |
| JP | 2002-107091 | 4/2002 |
| JP | 2004-177061 | 6/2004 |
| JP | 2004-263616 | 9/2004 |

* cited by examiner

*Primary Examiner*—Cheryl J Tyler
*Assistant Examiner*—Brandon M Rosati
(74) *Attorney, Agent, or Firm*—Gerald E. Hespos; Anthony J. Casella

(57) ABSTRACT

A heat exchanger tube has an inner peripheral surface serving as an exhaust gas flow path with a flat cross-sectional shape. A thin structure is incorporated in the heat exchanger tube and has a substantially rectangular channel-shaped waveform in cross section. The corrugated fin structure has a curved surface forming waveform meandering with a predetermined wavelength in the lengthwise direction. The wave width of the channel-shaped waveform is H, the wavelength of the waveform meandering in the lengthwise direction is L and the amplitude of the waveform meandering in the lengthwise direction is A. The heat exchanger tube is formed so that H/L is set at 0.17 to 0.20 and the ration (G/H) of a gap G determined by H−A to H is set at −0.21 to 0.19.

17 Claims, 8 Drawing Sheets

HEAT EXCHANGER TUBE

TECHNICAL FIELD

The present invention relates to a heat exchanger tube in what is called a shell-and-tube type exhaust gas cooling system. More particularly, it relates to a heat exchanger tube which is a heating tube having a flat cross-sectional shape that is arranged in plural numbers in a heat exchanger to form an exhaust gas flow path, incorporates a corrugated fin structure on the inner peripheral surface of the heating tube to enhance the heat exchange performance, and efficiently promotes heat exchange with a cooling medium flowing on the outside of the heating tube accomplished by flowing high-temperature exhaust gas in the exhaust gas flow path in the heating tube by making unique improvement on the corrugated fin structure to achieve a balance between the heat transfer performance brought by the corrugated fin structure and the loss of pressure.

BACKGROUND ART

A method in which some of exhaust gas is taken out of the exhaust system of a diesel engine, and is returned again to the air intake system and is added to an air-fuel mixture is called EGR (Exhaust Gas Recirculation). This method has been widely used as an effective method for purifying exhaust gas of diesel engine, and for improving the heat efficiency because many effects can be achieved, for example, the occurrence of NOx (nitrogen oxides) can be restrained, the loss of heat released to a coolant due to a decrease in pump loss and a lowering temperature of combustion gas is reduced, the ratio of specific heat is increased by a change of quantity and composition of working gas, and the cycle efficiency is accordingly improved.

If the temperature of EGR gas increases, and the quantity of EGR increases, however, the durability of EGR valve is deteriorated by the heat action of EGR gas, and the EGR valve may be broken at an early stage. Therefore, a cooling system must be provided to form a water cooling structure as preventive measures, or there occurs a phenomenon that the filling efficiency is decreased by the increase in intake air temperature and hence the fuel economy is decreased. To avoid such circumstances, a device for cooling the EGR gas using an engine cooling fluid, a refrigerant for air conditioner, or cooling air has been used. In particular, a large number of EGR gas cooling systems of a gas-liquid heat exchange type, which cool the EGR gas using the engine cooling fluid, have been proposed and used. Among these EGR gas cooling systems of a gas-liquid heat exchange type, an EGR gas cooling system of double-tube heat exchange type has still been demanded strongly. A large number of double-tube heat exchangers have been proposed including, for example, a double-tube heat exchanger in which an outer tube for allowing a liquid to pass through is disposed on the outside of an outer tube for allowing a high-temperature EGR gas to pass through, and in a heat exchanger for accomplishing heat exchange between gas and liquid, a metallic corrugated plate is inserted as a fin in the inner tube (for example, refer to Japanese Patent Laid-Open Publication No. 11-23181 (FIGS. 1 to 4)), and a double-tube heat exchanger which is formed by an inner tube for allowing a cooled medium to flow on the inside, an outer tube provided so as to surround the inner tube so as to be separated from the outer periphery of the inner tube, and a radiation fin having a thermal stress relaxing function that is provided in the inner tube (for example, refer to Japanese Patent Laid-Open Publication No. 2000-111277 (FIGS. 1 to 7)).

According to the double-tube heat exchanger incorporating a fin structure on which improvement has been made in various manners as described above, although the construction is simple and compact, a high cooling efficiency can be anticipated as such. Therefore, as a heat exchanger for cooling EGR gas that is used in a limited installation space such as a small-sized automobile, many double-tube heat exchangers have already been used practically. However, because of its compact construction, the absolute quantity of flowing fluid has a limit naturally. As a result, unsolved problems are remained in terms of the total heat exchange efficiency. In order to solve such problems, what is called a heat exchanger of a shell-and-tube type must inevitably adopted although the construction is somewhat complicated and large. The heat exchanger of this type has also been improved in various manners. As one example of the heat exchanger of a shell-and-tube type, a heat exchanger has been disclosed in which a cooling water inlet is provided at one end of the outer peripheral portion of a shell body forming a cooling jacket, and a nozzle serving as a cooling water outlet is provided at the other end thereof; a bonnet for introducing high-temperature EGR gas is integrally provided at one end in the lengthwise direction of the shell body, and a bonnet for exhausting heat-exchanged EGR gas is integrally provided at the other end thereof; a plurality of flat heating tubes are installed at intervals via a tube seat attached to the inside of the bonnet; the high-temperature EGR gas flows in the flat heating tubes so as to cross the cooling water flowing in the shell body; and a plate fin having a U-shaped cross-sectional shape is incorporated on the inner peripheral surface of the flat heating tube, by which the flow of flowing EGR gas is made a small stream, and at the same time, the heat transfer area is further increased, thereby providing a high heat exchange efficiency (for example, refer to Japanese Patent Laid-Open Publication No. 2002-107091 (FIGS. 1 to 3)).

On the other hand, in the above-described heat exchanger of a shell-and-tube type, to improve the heat exchange efficiency, it is an essential requirement to allow EGR gas, which is the cooled medium, to flow with uniform flow rate distribution and flow velocity in each heating tube that is disposed in large numbers at intervals in the shell to form a heating tube group, and at the same time, to produce a turbulent flow and agitating action appropriately between the fluids, which are the cooled medium and the cooling medium. According to the EGR gas cooling system shown in FIG. 9A, a flat heating tube 10 for heat exchanger has been proposed in which a heating tube that is disposed in large numbers in a shell body 30 forming a cooling jacket to form a heating tube group is a flat heating tube 10 consisting of a bottom portion 10-6 and an upper lid portion 10-5; as shown in FIG. 9B, a corrugated fin 20 having a substantially rectangular channel-shaped cross section and having waveform meandering 20-1 at predetermined intervals in the lengthwise direction is incorporated; and also, a turbulent flow forming portion 10-1 with respect to the gas flow is formed by providing a plurality of concave portions 10-3 and convex portions 10-2 on an exhaust gas flow path 10-4 in the flat heating tube 10 (for example, refer to Japanese Patent Laid-Open Publication No. 2004-263616 (FIGS. 1 to 10)). Also, a report has been made such that a periodic turbulent flow is produced in the EGR gas flowing in a gas flow path 10-4 in the flat heating tube 10 to effectively prevent the adhesion of soot, and the cooling medium such as cooling water flowing on the outer peripheral surface of the heating tube 10 is also agitated effectively, by which the heat exchange performance between gas and liquid is enhanced. Also, in the heat exchanger shown in FIG. 10A, a heat exchanger 40*a* for cooling exhaust gas in which an exhaust gas flow path 30*a*-1 is formed so as to have a flat cross-sectional shape and is laminated in a plurality of tiers is shown. In the flat exhaust gas flow path 30*a*-1, a corrugated fin structure 20*a* having a substantially rectangular channel-shaped cross-sectional plane as shown in FIG. 10C and having meandering in the lengthwise direction as shown in FIG. 10B is inserted. Thereby, a heat exchanger having a construction substantially similar to Japanese Patent Laid-Open Publication No. 2004-263616 (FIGS. 1 to 10) has been disclosed. The corrugated fin structure 20*a* in this example is formed so that, as shown in FIGS. 10B and 10D, the period of waves corresponding to the wave meandering viewed in a plan view, namely, the periods of peak lines 20*a*-3 and valley lines 20*a*-4 are longer than the period T2 on the outlet side 20*a*-6 of gas as compared with the period T1 on the inlet side 20*a*-7 of gas, and the corrugated fin structure 20*a* is inserted in the flat exhaust gas flow path 30*a*-1, by which a heat exchanger in which a gas flow path substituting the flat heating tube incorporating the corrugated fin is used has been proposed (for example, refer to Japanese Patent Laid-Open Publication No. 2004-177061 (FIGS. 1 to 4)). A report has been made such that by making the period of waves on the exhaust gas outlet side longer than that on the inlet side and a gentle curve, the flow of gas is accelerated and hence the accumulation of soot is prevented, and at the same time, the agitation of fluid is promoted and hence the heat exchange performance is enhanced.

In the above-described conventional arts, in the case of the double-tube EGR gas cooling system disclosed in Japanese Patent laid-Open Publication No. 11-23181 (FIGS. 1 to 4) and Japanese Patent Laid-Open Publication No. 2000-111277 (FIGS. 1 to 7), although the construction is simple and compact, a high cooling efficiency can be anticipated as such. Therefore, as a heat exchanger for cooling EGR gas that is used in a limited installation space such as a small-sized automobile, many double-tube heat exchangers have already been used practically. However, because of its compact construction, the absolute quantity of flowing fluid has a limit naturally. As a result, unsolved problems are remained in terms of the total heat exchange efficiency.

To solve the above-described problems, in the heat exchanger type EGR gas cooling system of a shell-and-tube type described in Japanese Patent Laid-Open Publication No. 2002-107091 (FIGS. 1 to 3) and Japanese Patent Laid-Open Publication No. 2004-177061 (FIGS. 1 to 4), improvement has been made such that the heat exchanger tube is made a flat heating tube having a larger heat transfer area, and the fin structure having a U-shaped cross section is incorporated in the flat heating tube; the corrugated fin incorporated in the flat heating tube is made a waveform having a substantially rectangular channel-shaped cross section and the corrugated fin is formed with waveform meandering in the lengthwise direction, and in addition, a plurality of irregularities are provided on the fluid flow path surface of the flat heating tube to form a turbulent flow forming portion; or the period of meandering in the lengthwise direction of the corrugated fin incorporated in the flat gas flow path in the laminated heat exchanger is made longer on the outlet side as compared with the period on the gas inlet side. Reports have been made such that by making improvement as described above, the accumulation of soot in the tube was prevented by producing a turbulent flow appropriately in the flow of EGR gas flowing in the gas flow path in the heating tube, or the agitating action of the cooling medium such as cooling water flowing on the outside of the heating tube was promoted, by which high heat exchange performance between gas and liquid was obtained, and some conventional arts have already been used practically. Actually, however, concerning the shape of wave as the corrugated fin structure that is incorporated in the flat heating tube and can effectively promote heat exchange between the high-temperature fluid flowing in the tube and the cooling medium flowing on the outside of the tube, the optimization has not yet been achieved. Therefore, substantially, a sufficient performance cannot be obtained, and room for further improvement is left.

More specifically, in the case where the heat transfer area in the heating tube is small, an attempt is made to enhance the heat transfer performance by increasing the flow velocity. In this case, however, the pressure loss increases inversely, and in addition, the adhesion of soot and dirt to the interior of flow path deteriorates the performance because an attempt is made to enhance the heat transfer performance by increasing the flow velocity. In the case where the number of heating tubes is increased to reduce the pressure loss, the heat transfer performance per one heating tube decreases, so that the volume of the heat exchanger itself increases to secure the initial performance. Therefore, there arise new problems of, for example, a serious hindrance in terms of layout.

DISCLOSURE OF THE INVENTION

By paying attention to the adhesion, viscosity, and inertia of unique soot that the fluid has, studies accompanied by various experiments were conducted from various aspects on the shape of wave in a corrugated fin structure which is incorporated in a flat heating tube and forms an EGR gas flow path. As a result, an optimum balance point between the flow velocity and the flow rate of EGR gas flowing in the heating tube was found by forming the wave width of transverse cross section serving as a gas flow path in the corrugated fin structure, the wavelength of waveform meandering formed in the lengthwise direction, and the radius of curvature of the meandering in a specific range. The present invention is an invention for achieving high heat exchange performance by keeping the loss of pressure to the minimum while high heat transfer performance in the flow path is maintained.

The present invention has been made to solve the above-described problems, and accordingly an object thereof is to provide a heat exchanger tube used in an EGR gas cooling system which makes it possible to introduce high-temperature EGR gas into the heat exchanger tube (heating tube) incorporated in the EGR gas cooling system with predetermined flow velocity and flow rate although the construction is simple by making improvement on the shape of wave of a corrugated fin structure forming an EGR gas flow path in the flat heating tube for heat exchanger, restrains the accumulation of soot generated in the heating tube and the adhesion of dirt, and is capable of obtaining high heat exchange performance.

To solve the above-described problems, the heat exchanger tube in the EGR gas cooling system in accordance with the present invention is a heat exchanger tube in which the inner peripheral surface serving as an exhaust gas flow path has a flat cross-sectional shape, characterized in that the fin structure incorporated in the heat exchanger tube has a substantially rectangular channel-shaped waveform in cross section, and in the corrugated fin structure having a curved surface forming waveform meandering with a predetermined wavelength in the lengthwise direction, when the wave width of the channel-shaped waveform is let be H, and the wavelength of waveform meandering in the lengthwise direction is let be L, the value indicated by H/L is adjusted so as to be within the range of 0.17 to 0.20.

Also, the heat exchanger tube in the EGR gas cooling system in accordance with the present invention is characterized in that in the corrugated fin structure, when the amplitude of waveform meandering in the lengthwise direction is let be A, the value indicated by G/H, where G is a gap determined by a difference (H-A) between the wave width H of the channel-shaped waveform and the amplitude A, is adjusted so as to be within the range of −0.21 to 0.19.

Further, the heat exchanger tube in the EGR gas cooling system in accordance with the present invention is a heat exchanger tube in which the inner peripheral surface serving as an exhaust gas flow path has a flat cross-sectional shape, characterized in that the fin structure incorporated in the heat exchanger tube has a substantially rectangular channel-shaped waveform in cross section, and in the corrugated fin structure having a curved surface forming waveform meandering with a predetermined wavelength in the lengthwise direction, the ratio H/L of the wave width H of the channel-shaped waveform to the wavelength L of waveform meandering in the lengthwise direction is adjusted so as to be within the range of 0.17 to 0.20, and when an amplitude of waveform meandering in the lengthwise direction is let be A, the value indicated by G/H, where G is a gap determined by a difference (H-A) between the wave width H of the channel-shaped waveform and the amplitude A, is adjusted so as to be within the range of −0.21 to 0.19.

The above-described heat exchanger tube in accordance with the present invention is characterized in that at the vertex of waveform meandering in the corrugated fin structure, the radius of curvature R is formed in the range of 1.7 H to 2 H for the wave width H of the channel-shaped waveform in the corrugated fin structure.

Further, the above-described heat exchanger tube in accordance with the present invention has a preferable mode such that a notch portion, slit, through hole, etc. are provided in an arbitrary shape in the side wall portion having a curved surface in the lengthwise direction in the corrugated fin structure so that a fluid can flow between adjacent fluid flow paths.

Still further, the above-described heat exchanger tube in accordance with the present invention has a preferable mode such that the corrugated fin structure is formed of a metallic sheet material, a fabrication means thereof is selected appropriately from press molding, gear molding, and a combination of these, and a joining means for joining the corrugated fin structure to the inner peripheral surface of the heating tube is selected appropriately from welding, brazing, adhesion, and other joining methods, by which the corrugated fin structure is joined to the inner peripheral surface of the heating tube.

Also, the above-described heat exchanger tube in accordance with the present invention has a preferable mode such that the metallic sheet material forming the corrugated fin structure consists of an austenitic stainless steel such as SUS304, SUS304L, SUS316, and SUS316L, and the thickness thereof is 0.05 to 0.3 mm.

Further, the above-described heat exchanger tube in accordance with the present invention has a preferable mode such that the heating tube has a substantially elliptical cross-sectional shape and is formed into a race track shape, or has a substantially rectangular cross-sectional shape and is formed into a rectangular shape in cross section.

For the heat exchanger tube in accordance with the present invention, the heating tube forming the exhaust gas flow path has a flat cross-sectional shape, and at the same time, the fin structure incorporated on the inner peripheral surface of the flat heating tube is a corrugated fin structure which has a waveform having a substantially rectangular channel-shaped cross section and has the curved surface formed with waveform meandering with a predetermined wavelength in the lengthwise direction. When the wave width of the channel-shaped waveform is let be H, and the wavelength of waveform meandering in the lengthwise direction is let be L, the value indicated by H/L is adjusted so as to be within a range of 0.17 to 0.20, and the value indicated by G/H, where G is a gap determined by a difference (H-A) between the wave width H and the amplitude A of waveform meandering in the lengthwise direction, is adjusted so as to be within a range of −0.21 to 0.19 as basic requirements. Further, at the vertex of waveform meandering in the corrugated fin structure, the radius of curvature R is formed in the range of 1.7 H to 2 H for the wave width H. Thereby, it is found that the exhaust gas flowing in the heating tube while maintaining a specific flow velocity is a region in which the pressure loss is not necessarily at the maximum when the heat exchange performance (heat transfer factor) is at the maximum. In addition, by providing the radius of curvature R in the specific range at the vertex of the waveform, the separation of flow at the vertex of the waveform is restrained, and the accumulation of soot and the adhesion of dirt are prevented. Thus, the heat exchanger tube in accordance with the present invention is formed by determining design values so that the heating tube has a flat cross-sectional shape, and the waveform of transverse cross section of the corrugated fin structure incorporated on the inner peripheral surface of the heating tube and the shape of waveform meandering zigzagging in the lengthwise direction are within predetermined ranges in advance. Thereby, a heat exchanger having effective cooling performance with excellent heat transfer performance can be provided. In order to further increase the effect of the present invention, the Reynolds number is preferably made a value near 2000 by adjusting the number of heating tubes provided in the heat exchanger, and it is preferable to use the heating tube in the region in which the Reynolds number is 5000 or smaller at the most.

Also, as is apparent from another embodiment in accordance with the present invention, the above-described heating tube can be selected appropriately from the publicly known conventional means. Although the heating tube can be manufactured easily by a very simple fabrication method and the means for joining the corrugated fin structure to the inner peripheral surface of the heating tube is also easy, the obtained effect is remarkably excellent. Therefore, the shell-and-tube type heat exchanger fitted with this heating tube can realize an EGR gas cooling system that is small in size and light in weight at a low cost, so that the present invention can be expected to make great contribution in terms of energy saving.

BEST MODE FOR CARRYING OUT THE INVENTION

An embodiment of the present invention will now be described in more detail and concretely with reference to the accompanying drawings. The present invention is not restricted by this embodiment. The design including the construction and shape of a heating tube and a corrugated fin structure incorporated in the heating tube can be changed freely in the scope of teachings of the present invention.

Figure 1:
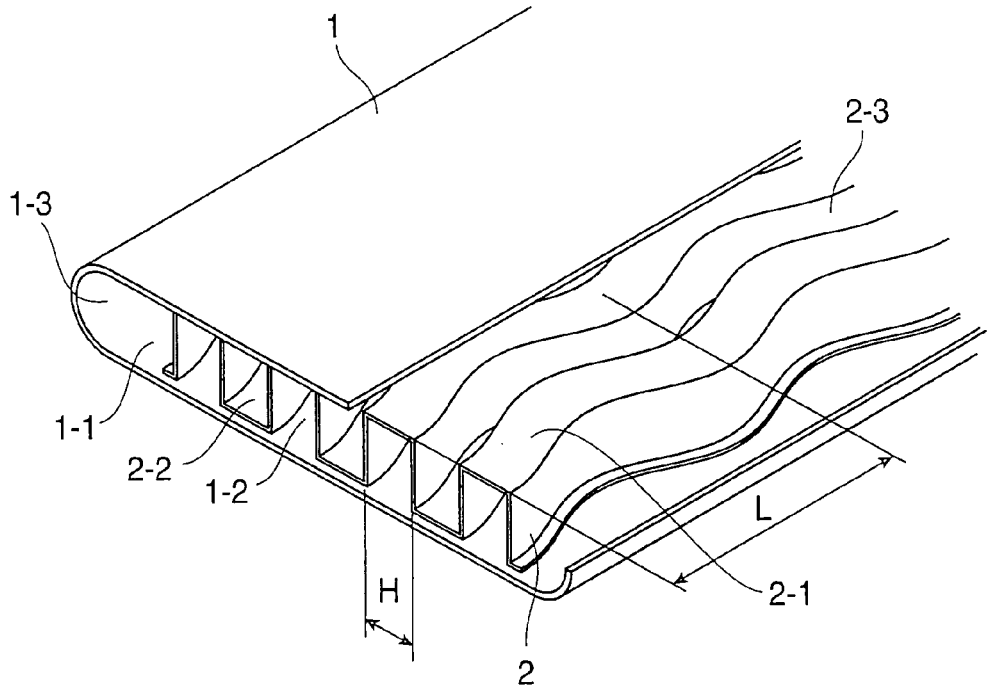
FIG. 1 is an enlarged perspective view of an essential portion schematically showing a heat exchanger tube in accordance with one example of the present invention and an incorporated corrugated fin structure.
Figure 2:
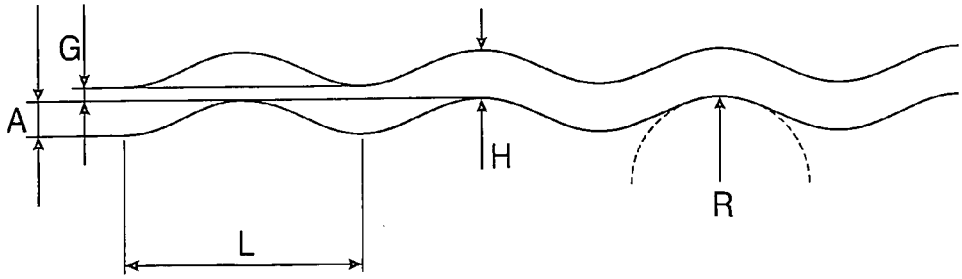
FIG. 2 is a schematic plan view for illustrating construction requirements of a corrugated fin structure in one example.
Figure 3:
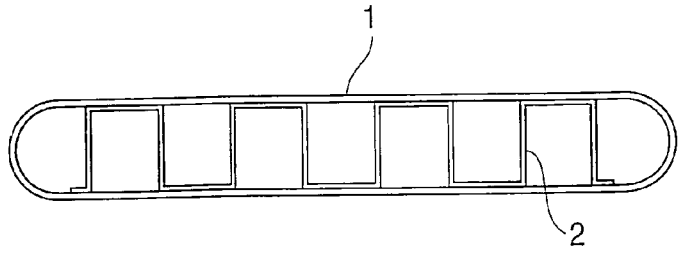
FIG. 3 is a transverse sectional view showing a single unit of heating tube in which a corrugated fin structure is incorporated in one example.
Figure 4:
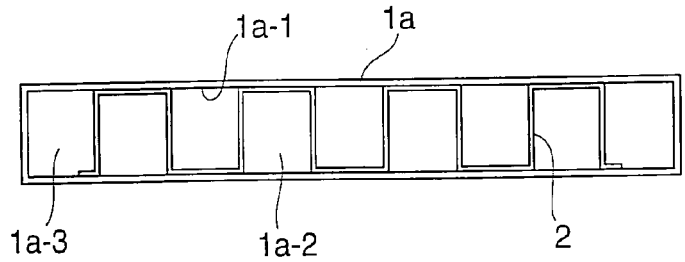
FIG. 4 is a transverse sectional view showing single unit of a heating tube in accordance with another example.
Figure 5:
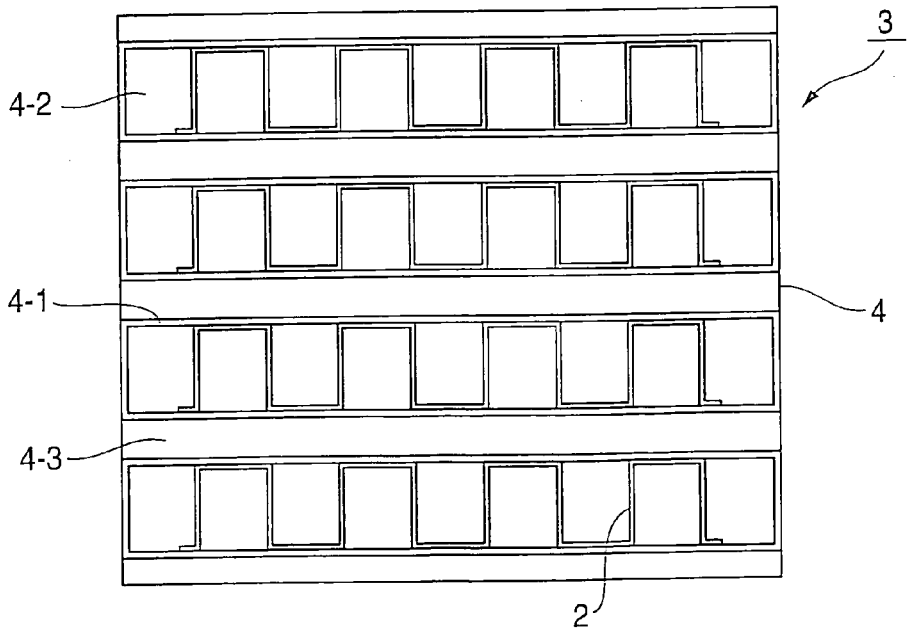
FIG. 5 is a transverse sectional view of an essential portion showing a state in which a corrugated fin structure is incorporated in a flow path of a laminated heat exchanger in which a plurality of stages of EGR gas flow paths having a rectangular cross section are formed in still another example relating to the present invention.
Figure 6:
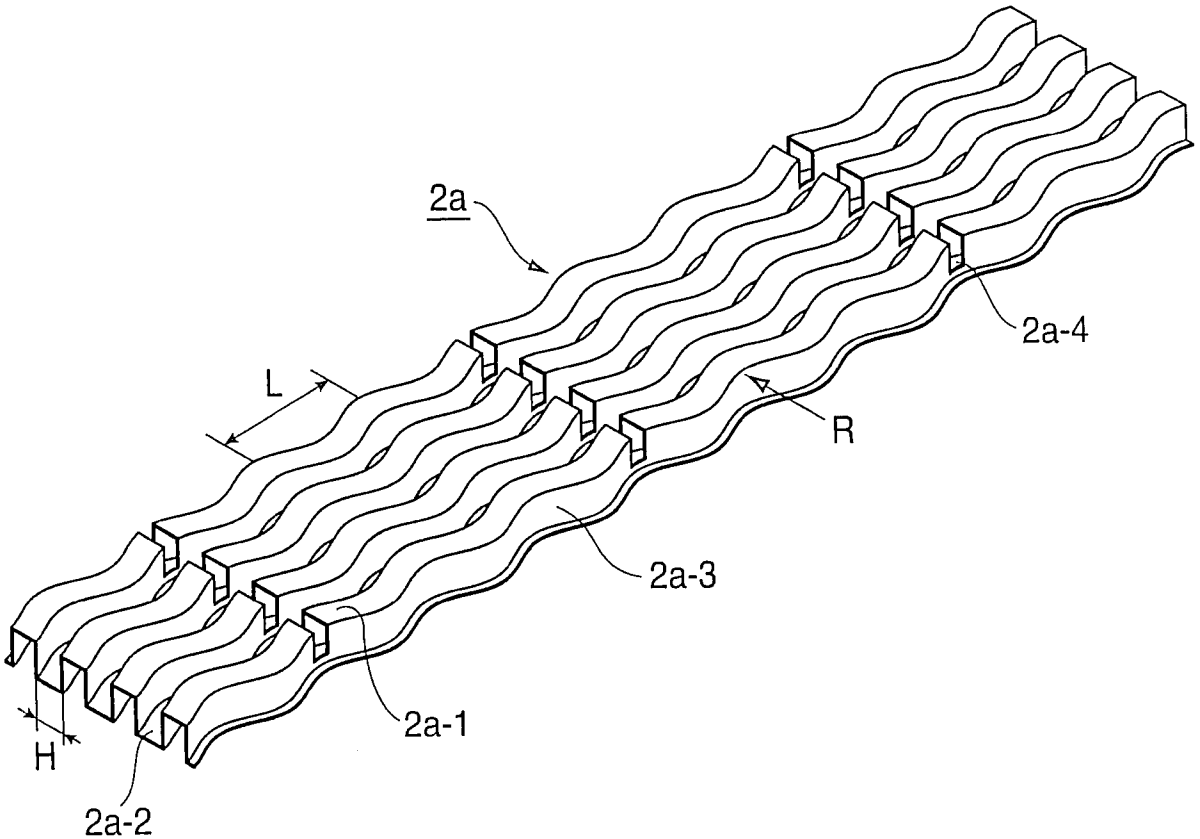
FIG. 6 is a perspective view of an essential portion showing a single unit of corrugated fin structure in accordance with one example of the present invention.
Figure 7:
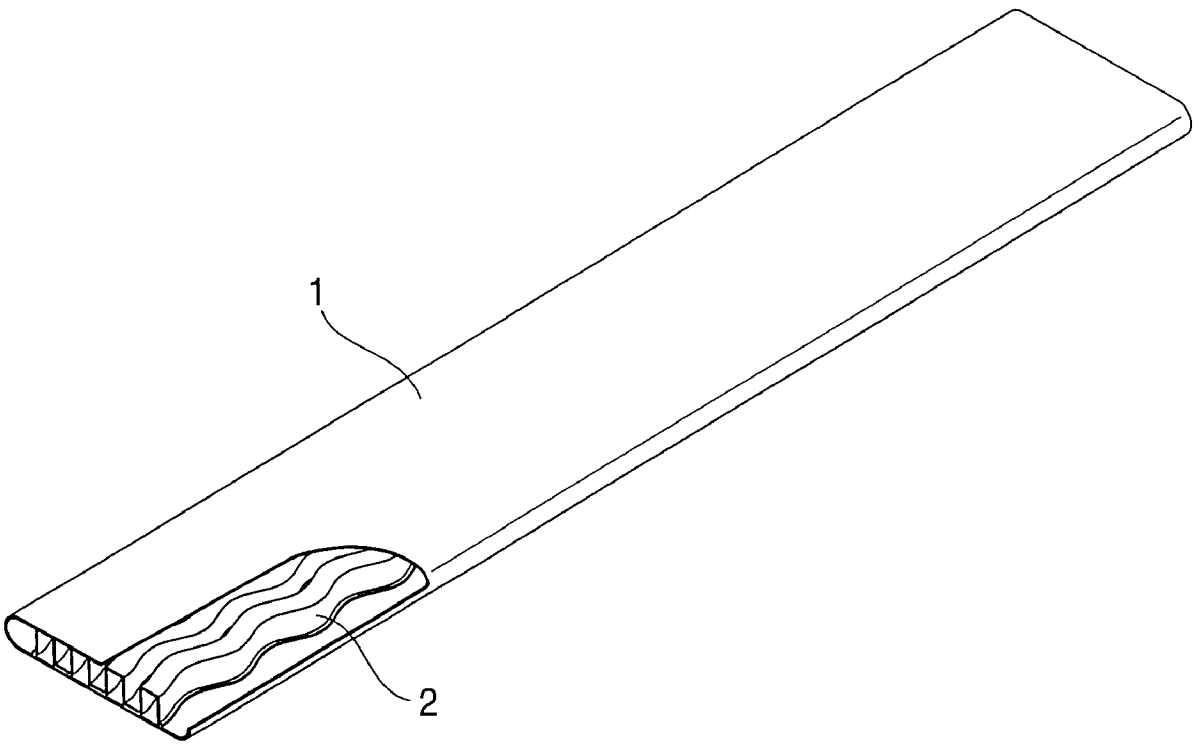
FIG. 7 is a partially broken perspective view showing a single unit of heating tube in accordance with one example of the present invention.
Figure 8:
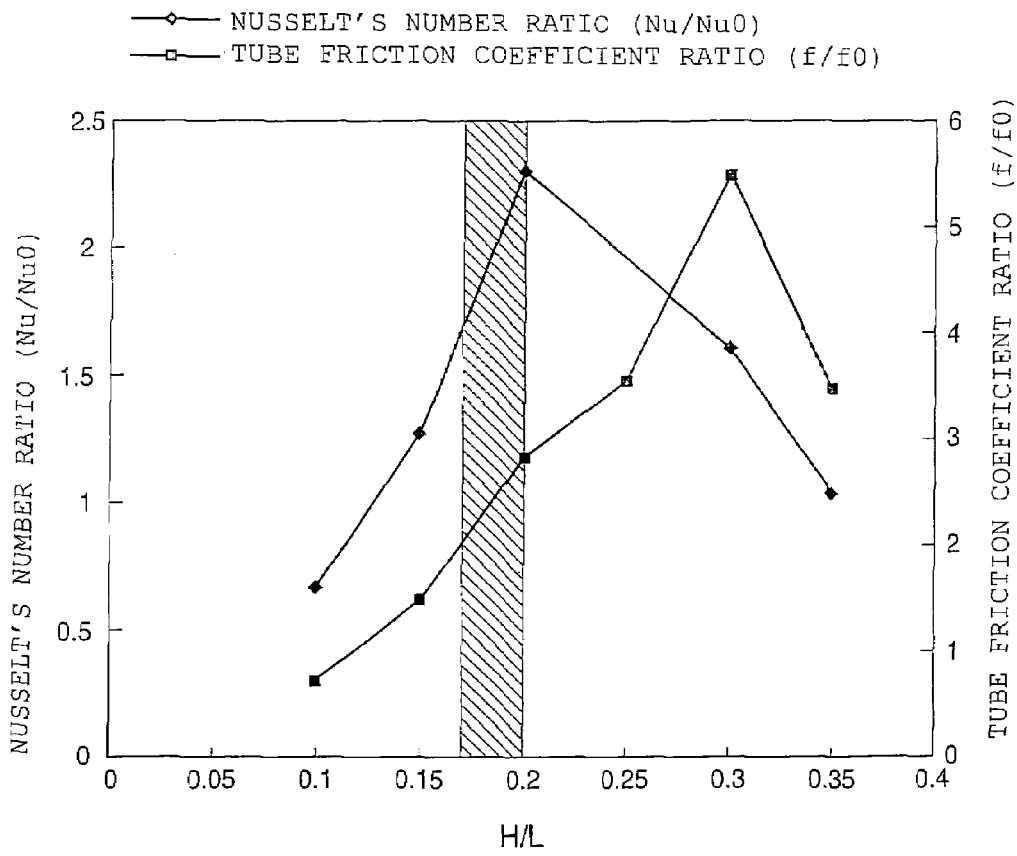
FIG. 8 is a diagram showing the relationship between a ratio of H/L in a corrugated fin structure and a ratio of Nusselt's number and a ratio of tube friction coefficient in accordance with the present invention.
Figure 9A:
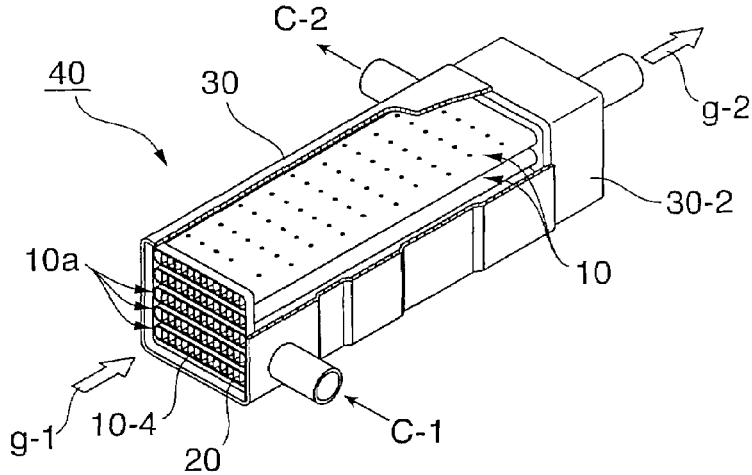
FIG. 9 shows a conventional heat exchange EGR gas cooling system, FIG. 9A being a partially broken perspective view thereof, FIG. 9B being an exploded perspective view of a single unit of heating tube used in the cooling system, and FIG. 9C being a transverse sectional view of a single unit of the heating tube.
Figure 9B:
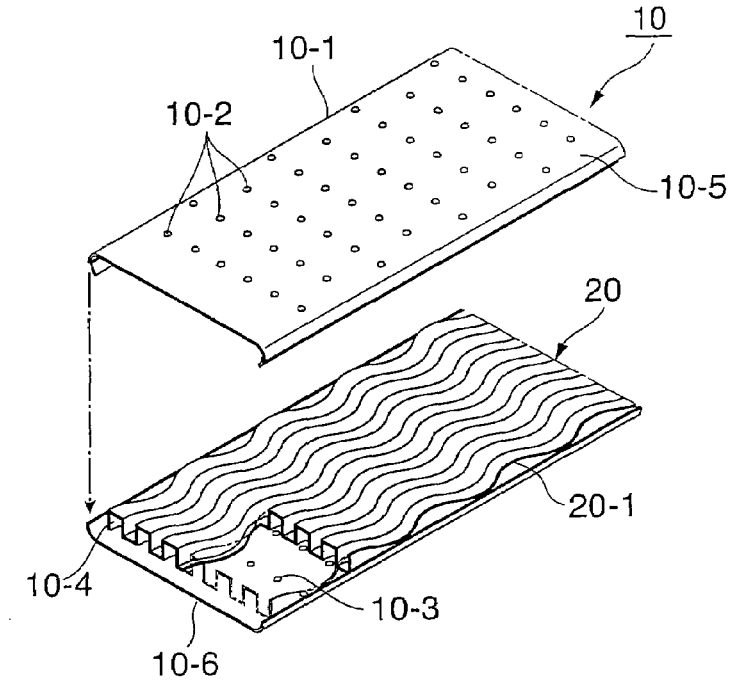
Figure 9C:
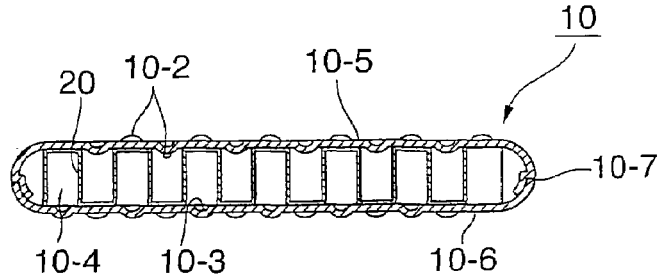
Figure 10A:
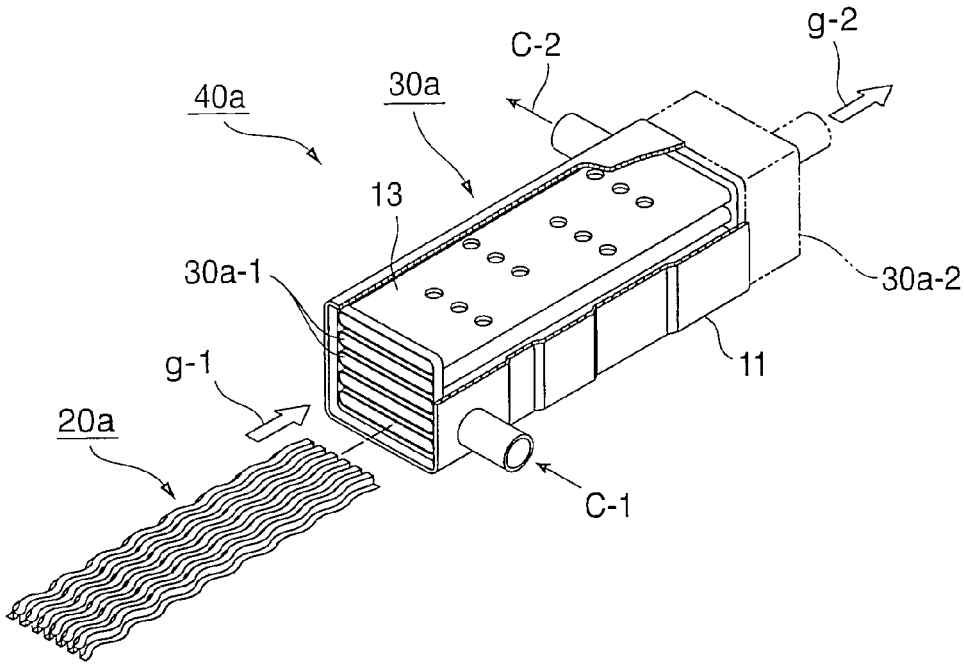
FIG. 10 shows a heat exchanger for an EGR gas cooling system of another conventional example, FIG. 10A being an exploded perspective view thereof, FIG. 10B being a plan view of a single unit of corrugated fin structure used in the heat exchanger, FIG. 10C being a schematic side view of a shell fin structure, and FIG. 10D being an explanatory view of the period of waves of the fin structure.
Figure 10B:
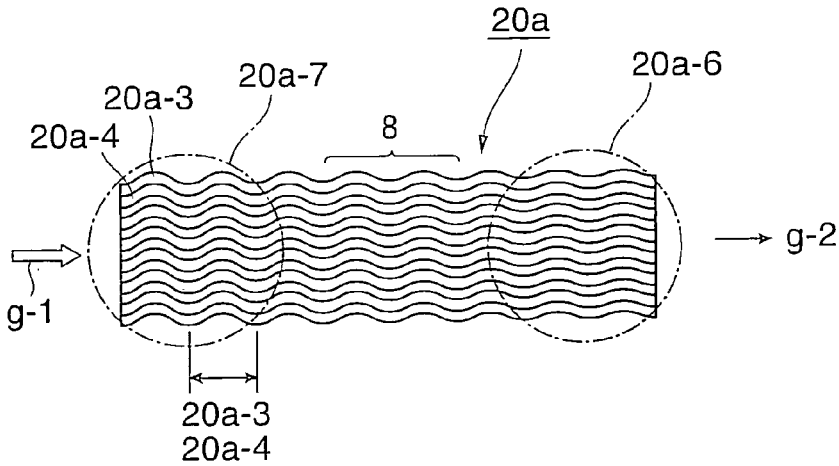
Figure 10C:
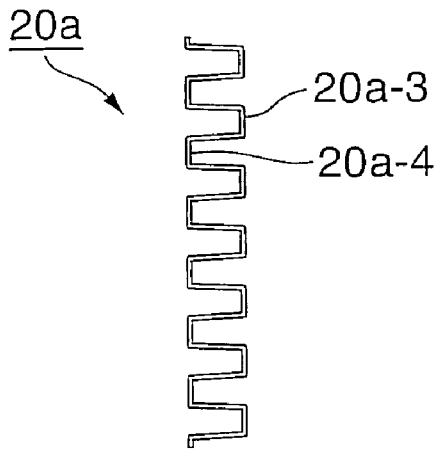
Figure 10D:
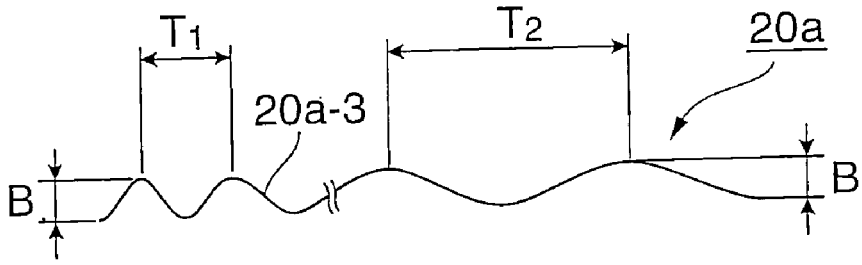

FIG. 1 is an enlarged perspective view of an essential portion schematically showing a heat exchanger tube in accordance with one example of the present invention and an incorporated corrugated fin structure, FIG. 2 is a schematic plan view for illustrating construction requirements of the corrugated fin structure in the example, FIG. 3 is a transverse sectional view showing a single unit of heating tube in which the corrugated fin structure is incorporated, FIG. 4 is a transverse sectional view showing single unit of a heating tube in accordance with another example, FIG. 5 is a transverse sectional view of an essential portion showing a state in which a corrugated fin structure is incorporated in a flow path of a laminated heat exchanger in which a plurality of stages of EGR gas flow path having a rectangular cross section are formed in still another example relating to the present invention, FIG. 6 is a perspective view of an essential portion showing a single unit of corrugated fin structure in accordance with one example of the present invention, FIG. 7 is a partially broken perspective view showing a single unit of heating tube in accordance with one example of the present invention, and FIG. 8 is a graph for illustrating the relationship between a proper value based on the wave shape of corrugated fin structure and a ratio of Nusselt's number (Nu/Nu0), described later, and a ratio of tube friction coefficient (f/f0) in accordance with the present invention.

EXAMPLE 1

For a heat exchanger tube (heat exchanger tube) 1 in accordance with example 1 of the present invention, as showing the essential portion thereof enlargedly in FIG. 1, the heating tube 1 was obtained by inserting and integrally joining, by brazing, a corrugated fin structure 2 in and to an inner peripheral surface 1-1 of a flat tube. The corrugated fin structure 2 was formed by press forming a sheet material of SUS304L austenitic stainless steel having a thickness of 0.05 mm. The flat tube was formed of a stainless steel material of the same kind having a thickness of 0.5 mm so as to have a substantially elliptical cross-sectional shape. For the fin structure 2 of this example, as shown in FIG. 1, the cross section of the fin structure is formed into a substantially rectangular channel shaped waveform, and waveform meandering zigzagging to the right and left in the lengthwise direction is formed. At this time, by letting the wave width H of the channel-shaped waveform be 3.0 mm, and letting the wavelength L of waveform meandering be 16.5 mm, a ratio (H/L) of wave width H to wavelength L was 0.182, and it was confirmed that this value was within the requirement range of 0.17 to 0.20.

Also, the fin structure 2 of this example was adjusted so that, in addition to the above-described requirement, by letting the amplitude A shown in FIG. 2 be 3.0 mm, the ratio (G/H) of a gap G determined by a difference (H-A) between the wave width H and the amplitude A to the wave width H of the channel-shaped waveform was within the range of −0.21 to 0.19. Further, adjustment was made so that as shown in FIG. 2, a radius of curvature of 6.0 R was formed at the vertex of waveform meandering formed in the lengthwise direction, and the radius of curvature R based on the channel-shaped wave width H was within the range of 1.7 H to 2 H. For the corrugated fin structure 2 in this example, the shape of wave is formed so as to meet the requirements, and at the same time, the corrugated fin structure 2 is joined by brazing so that a peak surface 2-1 and a valley surface 2-2 adhere closely to an inner peripheral surface 1-1 of the flat heating tube 1 in a flush manner. By joining the corrugated fin 2 to the inner peripheral surface 1-1 of the heating tube 1 in a closely adhering state, the heat of a high-temperature gas in a heating tube flow path is effectively heat exchanged to cooling water flowing on the outside of the heating tube 1 via the corrugated fin structure 2. Eight heating tubes 1 of this example, which were obtained as described above, were set to the gas flow path to form a an EGR gas cooling system by making adjustment so that the Reynolds number was 2300, and a cooling performance test was conducted. As the result, a high-temperature EGR gas flowing in the heating tube flowed in flow paths 1-2 and 1-3 of the heating tube 1 via a specific waveform curved surface of the corrugated fin structure 2 in a state in which predetermined flow rate and flow velocity were maintained. During this time, effective heat exchange is promoted, and due to the action of the radius of curvature R formed at the vertex of waveform meandering, the accumulation of large-amount soot and the extreme adhesion of dirt in the flow path were scarcely found. The heat exchange to a cooling jacket around the heating tube was promoted efficiently, and it was confirmed that the EGR gas discharged from the EGR gas outlet side was cooled to a predetermined temperature region.

In the heat exchanger tube 1 of this example, in order to determine the optimum value of the waveform in the incorporated corrugated fin structure 2, various studies were conducted. In these studies, a knowledge shown in the graph of FIG. 8 could be obtained. A ratio Nu/Nu0 or the Nusselt's number Nu of corrugated fin to the Nusselt's number Nu0 of a straight fin (straight line shaped fin), which expresses the tendency of heat transfer performance in a dimensionless manner, reaches the maximum when the ratio (H/L) of wave width H of the channel-shaped waveform to the wavelength L of waveform meandering in the lengthwise direction is 0.20.

In contrast, a tube friction coefficient ratio f/f0 of the tube friction coefficient f of the corrugated fin to the tube friction coefficient f0 of the straight fin, which expresses the tendency of pressure loss in a dimensionless manner, reaches the maximum when the value of H/L is 0.3. Therefore, if H/L exceeds 0.20, the pressure loss increases to a degree such that the heating tube cannot be used practically. Whereas, since the heat transfer performance decreases, evidence is provided that the specifications in this region is meaningless. On the other hand, a type in which the cost is 10% reduced and the weight is 20% reduced as compared with an EGR cooler having a straight fin that is easy to manufacture is sometimes demanded. Therefore, the length of the heating tube must be decreased by 40 percent. To decrease the length of the heating tube, the Nusselt's number of fin must be increased by 70 percent. For this purpose, the ratio H/L must be 0.17 or more. Thereupon, in the corrugated fin structure 2 in accordance with the present invention, in the relationship between the wave width H of the channel-shaped waveform in the transverse cross section and the wavelength L of waveform meandering, the range of H/L of 0.17 to 0.20, in which the tube friction coefficient ratio is low and the Nusselt's number ratio is high, is used. That is to say, as showing the relationship between H/L and Nusselt's number ratio and tube friction coefficient ratio in FIG. 8, the Nusselt's number ratio reaches the maximum at H/L of 0.20, whereas the tube friction coefficient ratio f/f0 reaches the maximum at H/L of 0.30. If H/L exceeds 0.20, the tube friction coefficient ratio increases, whereas the Nusselt's number ratio decreases. Therefore, the use of this region is meaningless. If H/L is lower than 0.17, the Nusselt's number ratio decreases, so that the use of this region is unsuitable as an efficient fin. In the present invention, therefore, a range of H/L from 0.17 to 0.20 in which the tube friction coefficient ratio is low and the Nusselt's number ratio is high is used.

Also, in the relationship between the amplitude A of waveform meandering in the lengthwise direction of the corrugated fin structure 2 and the wave width H of the channel-shaped waveform, adjustment is preferably made so that a ratio G/H of the gap G determined by the difference (H-A) to the wave width H is in the range of −0.21 to 0.19. If this ratio is lower than −0.21, the pressure loss increases, which may present a problem in terms of practical use. On the other hand, if the ratio exceeds 0.19, the heat transfer performance decreases extremely, so that the use as an efficient fin cannot be accomplished. Further, at the vertex of waveform meandering formed in the lengthwise direction, the radius of curvature R is formed for the wave width H not smaller than 1.7 H or larger than 2.0 H. In the case where the radius of curvature R is smaller than 1.7 H, the vertex of wave takes a pointed shape. Therefore, the gas flow greatly separates from the wall surface of the fin structure, so that the pressure loss increases, and at the same time, soot is liable to accumulate on the wall surface of the fin and dirt is liable to adhere to the wall surface of the fin. On the other hand, if the radius of curvature R exceeds 2.0 H, the tangential line of wave in the corrugated fin structure becomes discontinuous, and hence the waveform itself cannot be established. On the other hand, in the case where the heating tube in accordance with the present invention is used by being incorporated in the heat exchanger, to maintain the flow velocity range in the optimum state, the number of heating tubes is preferably regulated appropriately so that the Reynolds number is approximately 2000. It is preferable to use the heating tube in the region in which the Reynolds number is 5000 or smaller at the most.

EXAMPLE 2

A heat exchanger tube 1*a* in which the corrugated fin structure 2 was incorporated substantially in the same way as in example 1 excluding that the cross-sectional shape of the flat heating tube 1*a* was rectangular was obtained. The EGR gas cooling system was subjected to a cooling performance test under the same conditions as those of example 1, and resultantly excellent results that were the same as those of example 1 were confirmed.

EXAMPLE 3

A laminated heat exchanger 3 in which a plurality of stages of EGR gas flow paths 4-2 having almost the same specifications as those of the flat heating tube 1*a* in example 2 and having a rectangular cross section was prepared. As shown in FIG. 5, a fin structure 2*a* formed in almost the same specifications as those of example 1 was inserted in the flow path 4-2. By integrally joining, by brazing, the fin structure 2*a* to a partitioning wall 4-1 that partitioned a cooling water flow path 4-3, a laminated heat exchanger 3 in which the corrugated fin structure 2*a* that was substantially the same as that of example 1 was incorporated in the gas flow path 4-2 was obtained. The obtained laminated heat exchanger 3 was subjected to a cooling performance test in the EGR gas cooling system under the same conditions as those of example 1, and resultantly excellent results that were the same as those of example 1 were confirmed.

EXAMPLE 4

The flat heating tube 1 used in example 1 was prepared. As a corrugated fin structure 2*b* provided on the inner peripheral surface of the heating tube 1, by setting the wave width H of the channel-shaped waveform at 3.5 mm and setting the wavelength L of waveform meandering at 20.5 mm, it was confirmed that the ratio H/L of the wave width H to the wavelength L of waveform meandering was 0.171, being within the lower limit of the specified range of 0.17 to 0.20. Also, the fin structure 2*b* in this example was adjusted so that in addition to the above requirement, the amplitude A of wave shown in FIG. 2 is set at 4.2 mm, and the ratio (G/H) of the gap G determined by the difference between the wave width H and the amplitude A to the wave width H of the channel shape, namely, the difference (H-A), was within the upper limit range even in the range of −0.21 to 0.19. Further, at the vertex of waveform meandering formed in the lengthwise direction shown in FIG. 2, a radius of curvature of 6.0 R was formed, and adjustment was made so that the radius of curvature R based on the wave width H of the channel shape falls within the minimum range of 1.7 H to 2 H. A heat exchanger tube 1*c* was obtained in the same way as example 4 excluding the above description. A cooling performance test on the EGR gas cooling system was conducted under the same conditions as those of example 1, and resultantly excellent results that were the same as those of example 4 were confirmed.

EXAMPLE 6

A corrugated fin structure 2*d* having the same construction as that of example 1 excluding that a notch portion 2*d*-4 was formed in a curved side wall portion 2*d*-3 of the corrugated fin structure 2*d* so that the fluid could flow between the adjacent fluid flow paths as shown in FIG. 6 was formed. The fin structure 2*d* was incorporated in the flat heating tube in the same way as example 1, by which a heat exchanger tube 1*d* of this example was obtained. A cooling performance test in the ZGR gas cooling system was conducted under the same conditions as those of example 1, and resultantly excellent results that were the same as those of example 1 were confirmed.

INDUSTRIAL APPLICABILITY

As is apparent from the above-described examples, the heat exchanger tube in accordance with the present invention is a flat tube having a substantially elliptical cross-sectional shape or a substantially rectangular cross-sectional shape. The corrugated fin structure, which has a channel-shaped waveform having a substantially rectangular cross section and has a curved surface forming the waveform meandering with a predetermined wavelength in the lengthwise direction, is integrally incorporated in the flow path of cooled medium such as EGR gas on the inner peripheral surface of the flat tube, by which the heat exchanger tube is formed. For the heating tube in accordance with the present invention, the incorporated corrugated fin structure is configured so that when the wave width of the channel shape is let be H, and the wavelength of meandering is let be L, the ratio H/L is within the range of 0.17 to 0.20 as the basic requirement, and additionally, the ratio G/H of the gap G determined by a difference (H-A) between the wave width H and the amplitude A of the meandering to the wave width H is within the range of −0.21 to 0.19, and the radius of curvature R in the range of 1.7 H to 2 H is formed at the vertex of the meandering as additional requirements. By the heat exchanger tube in accordance with the present invention constructed as described above, the high-temperature exhaust gas such as EGR gas flowing in the heating tube secures excellent heat transfer performance and less pressure loss, and in the exhaust gas cooling system, the heat exchange performance that the cooling system has is delivered to the maximum, so that high cooling efficiency can be obtained, which contributes much to energy saving. Also, the heating tube in accordance with the present invention can be manufactured by a very simple manufacturing method including the incorporated corrugated fin structure, and the obtained effect is remarkably great despite the fact that the means for installing the heating tube into the heat exchanger is easy. Therefore, it is expected that the shell-and-tube type heat exchanger fitted with the heating tube will be widely used as a heat exchanger tube in its technical field because the EGR gas cooling system etc. can be made small in size and light in weight at a low cost.

What is claimed is:

1. A heat exchanger tube having an inner peripheral surface defining an exhaust gas flow path with a flat cross-sectional shape, a corrugated fin structure incorporated in the heat exchanger tube and having a substantially rectangular channel-shaped waveform in cross section, the corrugated fin structure having a curved surface forming a waveform meandering with a predetermined wavelength L in a lengthwise direction, the channel-shaped waveform defining a wave width H selected so that a value indicated by H/L is within a range of 0.17 to 0.20 and a vertex of the waveform meandering in the corrugated fin structure having a radius of curvature R in a range of 1.7 H to 2 H for the wave width H of the channel-shaped waveform in the corrugated fin structure.

2. The heat exchanger tube according to claim 1, characterized in that at least one notch, slit or through hole is provided in a side wall portion having a curved surface in the lengthwise direction in the corrugated fin structure so that a fluid can flow between adjacent fluid flow paths.

3. The heat exchanger tube according to claim 1, characterized in that the corrugated fin structure is formed of a metallic sheet material, a fabrication means thereof is selected from press molding, gear molding, and a combination of these, and a joining means for joining the corrugated fin structure to the inner peripheral surface of the heat exchanger tube is selected from welding, brazing, adhesion, and other joining methods.

4. The heat exchanger tube according to claim 1, characterized in that a metallic sheet material forming the corrugated fin structure consists of an austenitic stainless steel with a thickness of 0.05 to 0.3 mm.

5. The heat exchanger tube according to claim 1, characterized in that the heat exchanger tube has a substantially elliptical cross-sectional shape.

6. The heat exchanger tube according to claims 1, characterized in that the heat exchanger tube has a substantially rectangular cross-sectional shape.

7. A heat exchanger tube having an inner peripheral surface defining an exhaust gas flow path with a flat cross-sectional shape, a corrugated fin structure incorporated in the heat exchanger tube and having a substantially rectangular channel-shaped waveform in cross section, the corrugated fin structure having a curved surface forming waveform meandering with a predetermined wavelength L in a lengthwise direction and an amplitude A, the channel-shaped waveform defining a wave width H, a gap G determined by a difference (H−A) between the wave width H of the channel-shaped waveform and the amplitude A being is selected so that a value G/H is within a range of −0.21 to 0.19 and a vertex of the waveform meandering in the corrugated fin structure having a radius of curvature R in a range of 1.7 H to 2 H for the wave width H of the channel-shaped waveform in the corrugated fin structure.

8. The heat exchanger tube according to claim 7, characterized in that at least one notch, slit or through hole are provided in a side wall portion having a curved surface in the lengthwise direction in the corrugated fin structure so that a fluid can flow between adjacent fluid flow paths.

9. The heat exchanger tube according to claim 7, characterized in that the corrugated fin structure is formed of a metallic sheet material, a fabrication means thereof is selected from press molding, gear molding, and a combination of these, and a joining means for joining the corrugated fin structure to the inner peripheral surface of the heat exchanger tube is selected from welding, brazing, adhesion, and other joining methods.

10. The heat exchanger tube according to claim 7, characterized in that a metallic sheet material forming the corrugated fin structure consists of an austenitic stainless steel with a thickness of 0.05 to 0.3 mm.

11. The heat exchanger tube according to claim 7, characterized in that the heat exchanger tube has a substantially elliptical cross-sectional shape.

12. The heat exchanger tube according to claims 7, characterized in that the heat exchanger tube has a substantially rectangular cross-sectional shape.

13. A heat exchanger tube having an inner peripheral surface defining an exhaust gas flow path with a flat cross-sectional shape, a corrugated fin structure incorporated in the heat exchanger tube and having a substantially rectangular channel-shaped waveform in cross section, the corrugated fin structure having a curved surface forming a waveform meandering with a predetermined wavelength L in a lengthwise direction and an amplitude A, the channel-shaped waveform defining a wave width H selected so that a value indicated by H/L is within a range of 0.17 to 0.20, and a gap G determined by a difference (H−A) between the wave width H of the channel-shaped waveform and the amplitude A being selected so that a value G/H is within a range of −0.21 to 0.19 and a vertex of the waveform meandering in the corrugated fin structure having a radius of curvature R in a range of 1.7 H to 2 H for the wave width H of the channel-shaped waveform in the corrugated fin structure.

14. The heat exchanger tube according to claim 13, characterized in that at least one notch, slit or through hole, is provided in a side wall portion having a curved surface in the lengthwise direction in the corrugated fin structure so that a fluid can flow between adjacent fluid flow paths.

15. The heat exchanger tube according to claim 13, characterized in that the corrugated fin structure is formed of a metallic sheet material, a fabrication means thereof is selected from press molding, gear molding, and a combination of these, and a joining means for joining the corrugated fin structure to the inner peripheral surface of the heating tube is selected from welding, brazing, adhesion, and other joining methods.

16. The heat exchanger tube according to claim 13, characterized in that a metallic sheet material forming the corrugated fin structure consists of an austenitic stainless steel with a thickness of 0.05 to 0.3 mm.

17. The heat exchanger tube according to claim 13, characterized in that the heat exchanger tube has a substantially elliptical cross-sectional shape or a substantially rectangular cross-sectional shape.

* * * * *